US005988089A

United States Patent [19]

Benoit

[11] Patent Number: 5,988,089

[45] Date of Patent: Nov. 23, 1999

[54] SILENCER

[76] Inventor: Richard Benoit, 14 Manters Point, Plymouth, Mass. 02360

[21] Appl. No.: 09/210,455

[22] Filed: Dec. 14, 1998

[51] Int. Cl.[6] ..... B63H 9/04

[52] U.S. Cl. ..... 114/102.1; 114/111

[58] Field of Search ..... 114/102.1, 102.12, 114/102.18, 108, 109, 111

[56] References Cited

U.S. PATENT DOCUMENTS

| | | | |
|---|---|---|---|
| 3,996,873 | 12/1976 | Weghorn | 114/108 |
| 4,157,073 | 6/1979 | Vall | 114/102 |
| 4,473,024 | 9/1984 | Armstrong | 114/111 |
| 5,113,776 | 5/1992 | Knecht | 114/102.1 |
| 5,458,076 | 10/1995 | Loutrel et al. | 114/111 |
| 5,495,818 | 3/1996 | Woodcock | 114/111 |
| 5,738,031 | 4/1998 | Malina | 114/102.1 |

*Primary Examiner*—Ed Swinehart

*Attorney, Agent, or Firm*—Patent & Trademark Services; Thomas Zack; Joseph H. McGlynn

[57] ABSTRACT

Two spaced halyard restraining devices that are fixed to spreaders attached to a sailboat's mast. The two spaced spreaders are horizontally disposed from and fixed to opposite sides of an interposed vertically disposed mast. The halyard restraining devices are identical and each is shaped like a U-shaped bracket having one leg fixed to a spreader while another outer leg is a longer leg with a rounded free end. Each restraining device has a legs joining bight portion with the opened side facing generally either towards the boat's bow or stern. The halyard or the like are pulled into engagement with the device's bight portion to restrain their movement towards the mast by placing them under increased tension. To accommodate two different common cross sectional types of spreaders, round or wing shaped, the outer opposite side bearing surfaces of the inner leg may be shaped differently to complement these two types of spreader's shapes thus allowing for their dual-use with two different shaped spreaders.

1 Claim, 2 Drawing Sheets

SILENCER

BACKGROUND OF THE INVENTION

On windy days it is common for suspended ropes on sailboats to slap against the mast and other exposed boat parts creating loud noises. One solution is to use rope or elastic cord to tie or retain the suspended noise causing rope away from the mast. Another solution to abate the noise is to have arms that extend horizontally from the vertical mast. Neither tubular shaped C members may extend from the arms or some kind of wing to engage the vertically suspended noise causing rope. With the present invention the horizontally disposed arms mounted to the mast have a hooked shaped members fixed to them that can retain the movement of the suspended noise causing rope to prevent the same from slapping against the vertical mast even under strong wind conditions all as will be described in detail hereafter.

DESCRIPTION OF THE PRIOR ART

Devices for that are used to restrain the movement of sailboat ropes or riggings are known. For example, in the Weghorn invention (U.S. Pat. No. 3,996,873), a generally L-shaped clip is disclosed that is attached to the mast and is used to secure the halyards in a fixed position.

The Vall patent (U.S. Pat. No. 4,157,073) discloses a halyard securing device that is made up of a plastic helix which can also secure a shroud or other securing lines within the helix.

In U.S. Pat. No. 4,473,024 to Armstrong a self-locking device is disclosed that is positioned about standing rigging having mating tongue and grooves which upon engagement hold the device's two elements together in a locking condition.

In the Woodcock reference (U.S. Pat. No. 5,495,818) a shroud slap stopping mechanism is disclosed having a halyard enclosing ring that is attached by a line to a shroud through a system of pulleys.

The present invention relates to a halyard silencing device made up of two spaced spreader attached U-shaped devices whose opened bights portions face generally towards the sailboat's bow and stern all as more fully set forth in this specification.

SUMMARY OF THE INVENTION

This invention relates a sailboat's halyard silencing device which is used to retrain the movement of the halyards.

It is the primary object of the present invention to provide for an improved halyard silencing device that is attached to oppose mast mounted spreaders.

Another object is to provide for such a such a device having two U-shaped spreader mounted brackets whose opened bight portions face generally towards the bow and stern of the sailboat.

These and other objects and advantages of the present invention will become apparent to readers from a consideration of the ensuing description and the accompanying drawings.

DESCRIPTION OF THE PREFERRED EMBODIMENT

Figure 1:
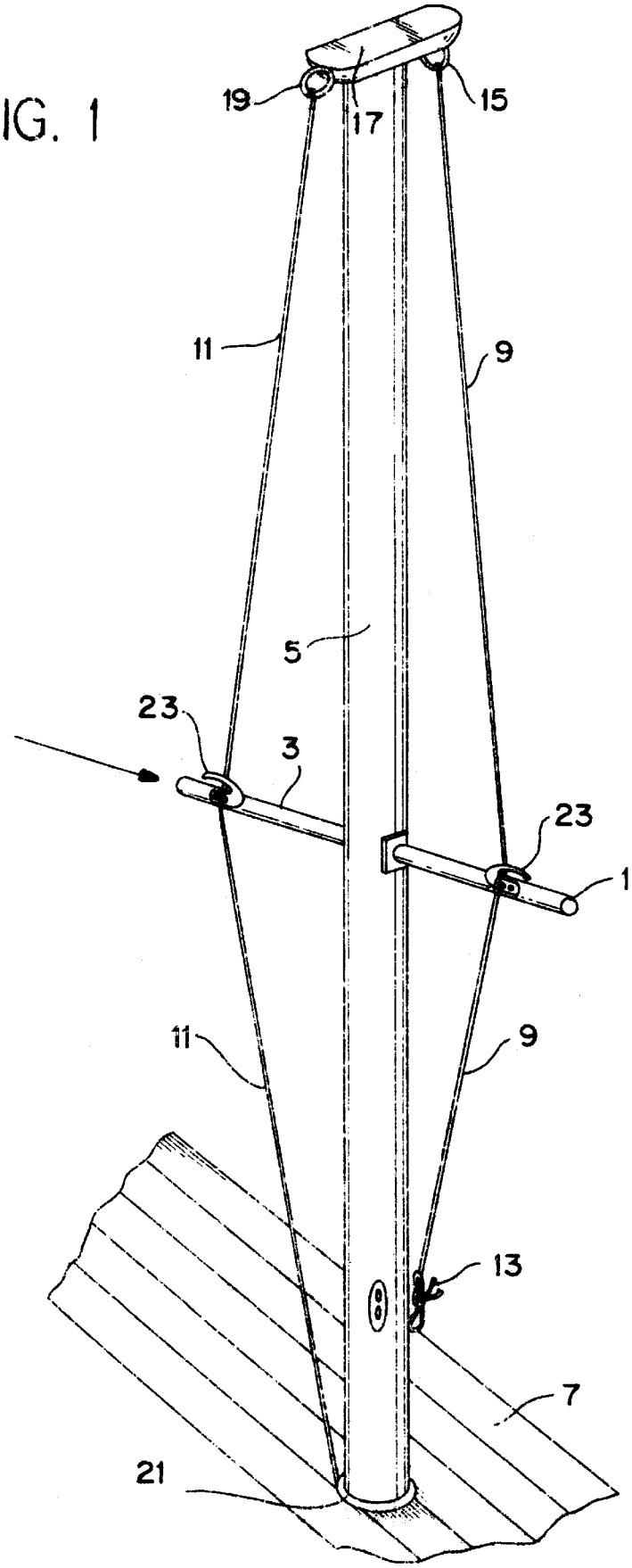
FIG. 1 is a side perspective view of the invention's preferred embodiment showing how it is mounted on two opposite mast attached spreaders of a sailboat.

FIG. 1 is a side perspective view of the invention's preferred embodiment showing how it is mounted on two opposite mast attached spreaders 1 and 3 of a sailboat. Each spreader is generally horizontally disposed and fixed to opposite sides of the vertically disposed intervening mast 5. The lower end of the mast is vertically support by the underlying sailboat's deck 7. Extending vertically on both sides of the mast are two separate halyards 9 and 11. It is the movement of these halyards against the mast 5 that the preferred embodiment of the invention seeks to restrain to thereby silence any noise caused by their slapping against the mast. The halyard 9 is fixed at its lower end 13 to the mast and at its upper end 15 to overhead mast structure 17. Similarly, the halyard 11 is attached to the overhead mast structure 17 at its top portion 19 while its lower end may be attached to lower mast end 21 adjacent the decking 7. All of the described structure of the mast, the halyards and their end supports and the two spreaders are conventional in design.

Fixed to the outer surfaces of the two spreaders 1 and 3 and about 18 inches outwardly from the center mast 5 are two preferred embodiments 23 of the invention. The devices 23 consist of U-shaped brackets that are fixed on one of their respective legs to the spreader while the bight portion of the bracket engages the halyard in a restraining position to keep the halyard from slapping into the mast 5.

Figure 2:
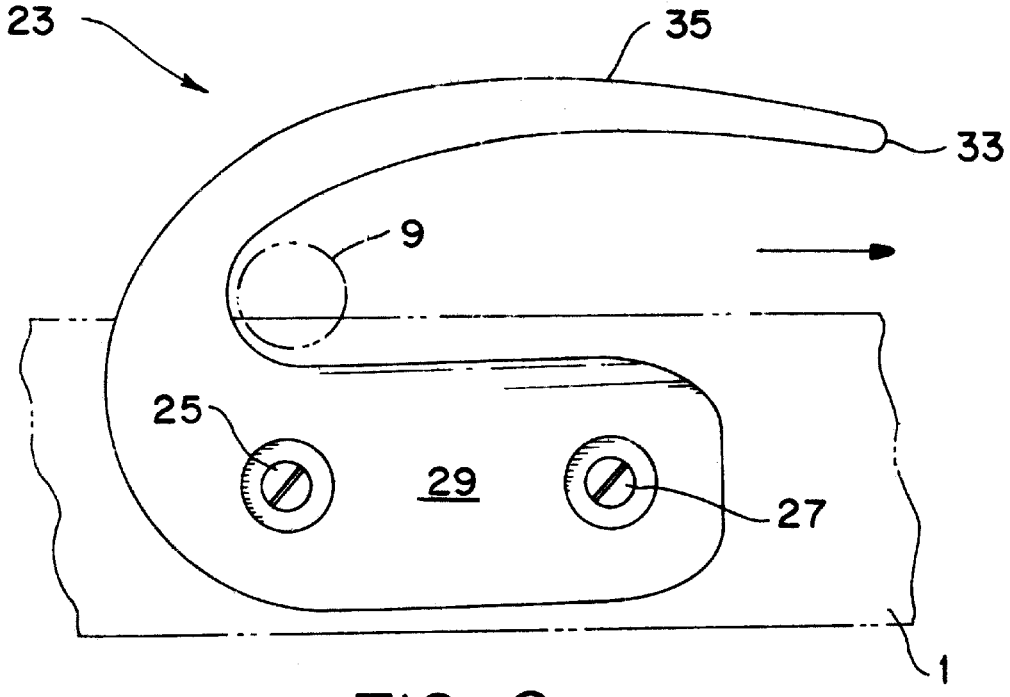
FIG. 2 is a top view of the preferred embodiment of the device used in FIG. 1.

FIG. 2 is a top view of the preferred embodiment of the device 23 used in FIG. 1. The spreader 1, shown in dotted line format, is located underneath the device 23 and is fixed thereto by two spaced screws 25 and 27, whose heads are shown, that extend through preformed spaced holes in the inner leg portion 29 of device 23. A bight portion 31 of device 23 attaches the two legs of the device together and faces towards the sailboat's bow (see arrow) such that the opened part of the U-shaped device is facing in the same direction. The halyard 9 is shown in cross sectional dotted line format as it engages the device's bight portion 31 when the halyard is subjected to a minimum amount of end tension. The free end 33 of the outer leg 35 is longer than inner leg 29, and extends closer to the ship's bow and has a round end so as not to damage the bight insertable halyard should it bear against leg's 35 end.

The other device 23 on spreader 3 would have the same construction as that shown in FIG. 2 but would have its bight portion facing towards the sailboat's stern. The halyard 11 would also engage the device's bight portion 31 and be restrained from movement at the point of engagement towards the mast 5.

The two horizontally disposed spreaders 1 and 3 have cross sectional configurations that are either tubular or round or they may be configured like the shape of an airplane's wing in cross section. To accommodate these two different possible cross sectional configurations for the spreaders, the device's inner leg 29 has its outer engaging spreader surfaces shaped to lie flush against the outer surface of the spreader regardless of which spreader cross sectional configuration is present.

Figure 3:
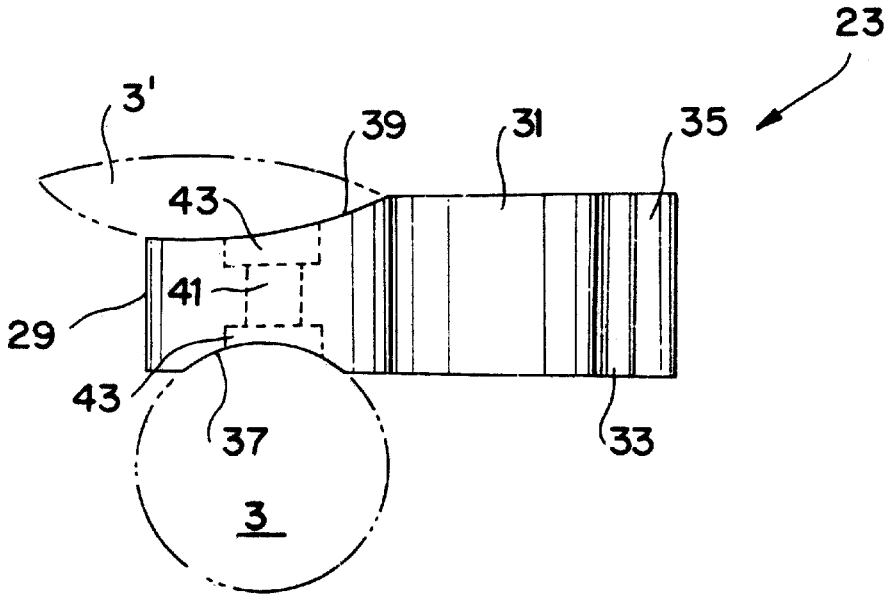
FIG. 3 is a end view of the preferred embodiment of the device used in FIG. 1 looking toward the boat's mast.

FIG. 3 is a end view of the preferred embodiment of the device used in FIG. 1 looking toward the boat's mast as indicated by the arrow in FIG. 1 . Shown in dotted line format are the two generally available cross sectional configurations 3 and 3' for the spreaders. Normally either one or the other of the spreader configurations would be used at the same time and not both configurations. Thus, each of the spreaders 1 and 3 would have the same cross sectional configurations whether round or winged, To accommodate the two different types of possible configurations for the spreaders, the two opposite outer surfaces of the leg 29 that may bear against the spreader's surface are shaped differently. Thus, if the cross sectional configuration for the spreader were round as shown by 3, the surface 37 of leg 29 that bears against it would have a round complementary shape. Similarly, if the spreader has a winged shaped cross sectional configuration, like in 3', the leg 29 has an outer surface 39 that bears against that is wing shaped to complement the spreader's wing shape. In this manner regardless of which spreader cross sectional configuration is available, round or winged, the leg 29 may lie flush against the spreader and complement its outer surface in shape. Extending completely through the height of leg 29 are two spaced through holes one for each of the screws 25 and 27. One of these identical through holes 41 is shown in FIG. 3 having two larger diameter bores 43 and 45 at their opened ends. This allows headed screws to be inserted from either of the leg's two opposite surfaces 37 or 39 into the spreader to fix the device 23 to the spreader. By flipping over the device 23, depending on the cross sectional shape of the spreader, the two devices can each be positioned and fixed to the spreaders on opposite sides of the mast 5 with their two respective opened ends facing generally towards the bow and stern of the sailboat.

In use, a user would grasp one of the halyards along its length and pull it away from the mast until it could engage with the opened bight of the two fixed devices 23 one at a time. This would further tension the halyards 9 and 11 to restrain their movement toward the center intervening mast 5 to silence any slapping sound against the mast.

Since the devices 23 will be used outdoors and exposed to a considerable amount of moisture, they should be made of a moisture resistant material such as molded plastic or white nylon ultraviolet resistant material. Normally they would be molded as a one piece unitary structure and be screwed with four stainless steel screws into the two spreaders about 18 inches from the mast. In one working embodiment, the longer leg 35 had an overall length of 3 and ⅛ inches, the bight had a width of 1 inch and the shorter inner leg had an overall length of 2 inches. The height or thickness of the leg 35 (see FIG. 3) was about ¾ of an inch while the height or thickness of inner leg 29 was about ½ of an inch. Clearly, other dimensions may be used depending on the cross sections of the halyards or other lines to be restrained, the dimensions of the spreaders and the amount of resistance needed to restrain the halyards from slapping into the mast.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A sailboat mast with a spreader, a halyard and a halyard restraining bracket comprising in combination:

a vertically disposed sailboat mast;

a horizontally disposed sailboat spreader fixed to said vertically disposed mast;

an elongated vertically disposed halyard suspended to one side of said mast and engageable with a U-shaped bracket: and a U-shaped bracket device fixed to said spreader and horizontally spaced from said mast, said bracket device having an inner leg and an outer leg with said inner leg being engaged with and fixedly secured on said spreader, said outer leg being longer than said inner leg with a rounded free end, said inner leg having a fastener receiving hole to permit the attachment by a fastener to the spreader, said inner leg having two opposite side outer surface configurations each with a different cross sectional shape to permit the engagement of the inner leg to two different spreaders that have two different cross sectional configurations, each of said two spreader cross sectional shapes complementing the shape of one of the outer surface configurations of the inner leg whereby a halyard can be restrained from engaging the mast near where engaged by the spreader supporting the U-shaped bracket.

* * * * *